United States Patent [19]

Miyamoto et al.

[11] Patent Number: 4,619,712

[45] Date of Patent: Oct. 28, 1986

[54] SUPERPLASTIC ALUMINUM ALLOY STRIPS AND PROCESS FOR PRODUCING THE SAME

[75] Inventors: Hitoshi Miyamoto, Kawasaki; Masanori Momochi, Machida; Ryoji Mishima, Yokohama, all of Japan

[73] Assignee: Mitsubishi Light Metal Industries Limited, Tokyo, Japan

[21] Appl. No.: 589,850

[22] PCT Filed: Nov. 9, 1982

[86] PCT No.: PCT/JP82/00434

§ 371 Date: Jul. 7, 1983

§ 102(e) Date: Jul. 7, 1983

[87] PCT Pub. No.: WO83/01629

PCT Pub. Date: May 11, 1983

Related U.S. Application Data

[62] Division of Ser. No. 519,778, Jul. 7, 1983, abandoned.

[30] Foreign Application Priority Data

Nov. 10, 1981 [JP] Japan ..... 56-180247

[51] Int. Cl.[4] ..... C22F 1/047

[52] U.S. Cl. ..... 148/2; 148/11.5 A; 148/440; 420/902

[58] Field of Search ..... 148/2, 11.5 A, 440; 420/902, 546

[56] References Cited

U.S. PATENT DOCUMENTS

| | | | |
|---|---|---|---|
| 1,871,607 | 8/1932 | Hall et al. | 420/546 |
| 3,306,787 | 2/1967 | Dies | 148/440 |
| 3,717,512 | 2/1973 | Sperry et al. | 148/440 |
| 3,868,250 | 2/1975 | Zimmermann | 420/535 |
| 3,930,895 | 1/1976 | Moser et al. | 148/2 |
| 3,945,860 | 3/1976 | Winter et al. | 148/11.5 A |
| 4,411,707 | 10/1983 | Brennecke et al. | 148/2 |
| 4,531,977 | 7/1985 | Mishima et al. | 148/2 |

FOREIGN PATENT DOCUMENTS

| | | | |
|---|---|---|---|
| 0118214 | 10/1978 | Japan | 148/11.5 A |
| 0025207 | 2/1979 | Japan | 148/11.5 A |
| 0139646 | 10/1981 | Japan | 420/546 |
| 0152453 | 9/1982 | Japan | 420/902 |
| 467672 | 6/1937 | United Kingdom . | |
| 2027744A | 2/1980 | United Kingdom . | |

*Primary Examiner*—L Dewayne Rutledge
*Assistant Examiner*—Robert L. McDowell
*Attorney, Agent, or Firm*—Cushman, Darby & Cushman

[57] ABSTRACT

Superplastic aluminum alloy strips comprising 1.5 to 90% of magnesium, 0.5 to 5.0% of silicon, 0.05 to 1.2% of manganese, 0.05 to 0.3% of chromium and the balance consisting essentially of aluminum, and also a process for producing superplastic aluminum alloy strips comprising continuously casting and rolling a molten aluminum alloy containing 1.5 to 9.0% of magnesium, 0.5 to 5.0% of silicon, 0.05 to 1.2% of manganese and 0.05 to 0.3% of chromium, thereby obtaining a cast strip of 3 to 20 mm in thickness, homogenizing the cast strip at a temperature of 430° to 550° C., and subjecting the homogenized strip to cold rolling until the reduction ratio reaches up to a value of not less than 60%.

3 Claims, 2 Drawing Figures

SUPERPLASTIC ALUMINUM ALLOY STRIPS AND PROCESS FOR PRODUCING THE SAME

Figure 1:
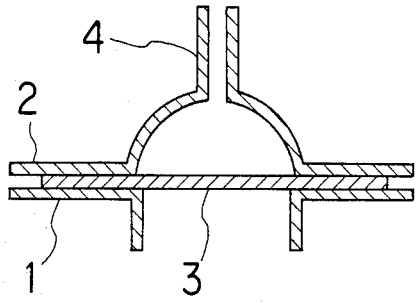

This is a division, of application Ser. No. 519,778, filed July 7, 1983, abandoned.

DESCRIPTION

1. Technical Field

The present invention relates to superplastic aluminum alloy strips and a process for producing the same. Particularly, the present invention relates to a process for easily producing superplastic aluminum alloy strips on an industrial scale.

2. Background Art

Metals or alloys which can be elongated to an abnormal extent of hundreds to thousand percents without generating local deformation (necking) when a mechanical force is externally applied thereon have been known as superplastic metals or superplastic alloys. In general, these superplastic metals and alloys are broadly divided into the two types of extra fine crystal grain-type and transformation-type according to the mechanism of showing their superplasticity. The superplastic alloys based on aluminum are classified to the extra fine crystal grain-type superplastic alloys and according to their fine crystal structure made with crystal grains of from 0.5 micrometer or less to 10 micrometers in diameter, the material of superplastic aluminum alloy is easily subjected to the plastic deformation by the smooth grain boundary migration or sliding.

It is an object of the present invention to provide a strip of superplastic aluminum alloy having excellent superplasticity.

Another object of the present invention is to provide a process for producing superplastic aluminum alloy strips showing excellent superplasticity by combining the composition of the alloy and the conditions in casting and rolling.

Disclosure of Invention

The subject matters of the present invention consist in superplastic aluminum alloy strips comprising 1.5 to 9.0% (by weight, hereinafter % relating to an alloy component always means % by weight) of magnesium, 0.5 to 5.0% of silicon, 0.05 to 1.2% of manganese, 0.05 to 0.3% of chromium and the balance consisting essentially of aluminum, and also a process for producing superplastic aluminum alloy strips comprising continuously casting and rolling a molten aluminum alloy containing 1.5 to 9.0% of magnesium, 0.5 to 5.0% of silicon, 0.05 to 1.2% of manganese and 0.05 to 0.3% of chromium, thereby obtaining a cast strip of 3 to 20 mm in thickness, homogenizing the cast strip at a temperature of 430° to 550° C., and subjecting the homogenized strip to cold rolling until the reduction ratio reaches up to a value of not less than 60%. The aluminum alloy strips of the present invention shows excellent super-plasticity at a temperature of higher than 400° C., particularly in the range of 450° to 600° C.

BRIEF DISCRIPTION OF THE DRAWING

Figure 2:
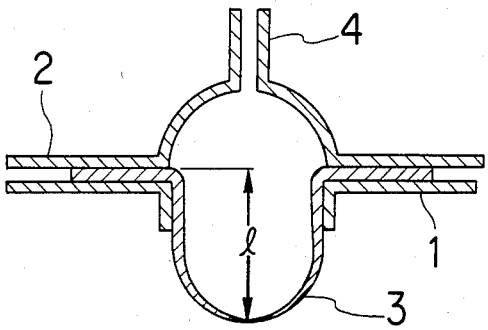

FIGS. 1 and 2 respectively show a typical cross-sectional view of a metal mold for the bulge test used in Examples of the present invention. FIG. 1 shows the state in which a test sheet is set to the metal mold, and FIG. 2 shows the state in which the test sheet has been expanded downward by compressed air.

BEST MODE OF CARRYING OUT THE INVENTION

The present invention will be explained more in detail as follows.

The superplastic aluminum alloy strip according to the present invention contains 1.5 to 9.0% of magnesium, 0.5 to 5.0% of silicon, 0.05 to 1.2% of manganese and 0.05 to 0.3% of chromium, and the balance consisting essentially of aluminum.

In the dynamic recrystallization, namely, the plastic deformation of the superplastic aluminum alloy strip, magnesium and silicon have a function of regenerating always the original structure before the deformation by recrystallization simultaneous with the deformation. In the case where the amount of magnesium and silicon is too small, their effect is not fully exhibited, and on the other hand, in the case where their amount is too large, the workability of the alloy strip, particularly the rollability of the alloy strip is deteriorated. The preferable each content of magnesium and silicon is 2.0 to 8.0% and 1.0 to 4.0%. Magnesium and silicon form together with a compound ($Mg_2Si$) and this compound, as being fine particles, contributes to the exhibition of superplasticity. Manganese and chromium refine the crystal grain and have a stabilizing effect. In the case of the small content of manganese and chromium, these can not exhibit the effect mentioned above and also, in the case of too large content thereof, these make coarse intermetallic substances and deteriorate the superplasticity of the obtained alloy. The preferable content of manganese is 0.1 to 0.7%, particularly 0.3 to 0.7%. The preferable content of chromium is 0.1 to 0.2%.

To the superplastic aluminum alloy according to the present invention, transition elements such as zirconium, may be further added as far as the added element does not reduce the effects of the above-mentioned elements. Further, it may be carried out to add minute amounts of titanium and boron to the alloy for refining the crystal grain and furthermore, it may be carried out to add a minute amount of beryllium for preventing the oxidation of magnesium.

Moreover, the presence of impurities contained generally in aluminum alloys such as iron, copper and the like, may be harmless as far as the content thereof is in the commonly allowable range, namely, not more than 0.4% of iron and not more than 0.1% of copper.

In the production of the superplastic aluminum alloy strips according to the present invention, at first, the molten aluminum alloy of the above-mentioned composition is continuously cast and rolled to produce directly a cast strip of 3 to 20 mm, preferably 4 to 15 mm in thickness. The process for continuous casting and rolling has been well known and several processes, for instance, Hunter's process and 3C process have been known. According to these processes for continuous casting and rolling, a molten aluminum alloy is introduced into between the driving molds through a nozzle in which the molds are constructed with a pair of rotating rolls used for casting and the likes and a cast strip is formed by simultaneously cooling and rolling the molten alloy in the molds. In this process, since solubility of manganese and chromium into strips is raised, they hardly crystallize out as far as their content is in the above-mentioned range, and when combined with the successive heat-treatment, it is possible to remarkably improve the refining effect on recrystallized grains. The speed of continuous casting (the running velocity of strips) is preferably 0.5 to 1.3 m/min and the temperature of the molten alloy is preferably 650° to 700° C.

The cast strips thus obtained are subjected to homogenization at a temperature of 430° to 550° C. The time period of homogenization treatment is appropriately 6 to 24 hours. The homogenization treatment is effected for a longer time at a lower temperature and for a shorter time at a higher temperature as usual thermal treatment. By this homogenization treatment, magnesium which has once crystallized out is homogeneously brought into uniformly dissolved state and is able to improve the effect of magnesium on dynamic recrystallization. In addition, it is possible to bring the material, which has crystallized out during the casting, into spherical shape thus smoothing the superplastic grain boundary migration. Moreover, it is possible also to make manganese and chromium, which have become supersaturated in a solid solution, crystallize out as the uniform and extra fine precipitates which are effective in preventing the boundary migration of recrystallized grains. In the case where the temperature of homogenizing-treatment is lower than 430° C., these effects can not be manifested. On the other hand, in the case of higher than 550° C., the amount of manganese and chromium to be crystallized out is reduced while precipitates are coarsened and accordingly, the effect of preventing the boundary migration of recrystallized grains is remarkably reduced.

The strip thus homogenized is successively subjected to cold rolling without preceding hot rolling. If the strip is subjected to hot rolling, it becomes impossible to maintain the controlled state of crystallization of the elements of the alloy and the superplasticity of the aluminum alloy strip thus obtained is impaired. The cold rolling is effected to reach up to a reduction ratio of not less than 60%, preferably up to not less than 70%. Sufficient superplasticity can not be provided at a reduction ratio of less than 60%. In consideration of the usage of the superplastic alloy strips, the cold rolling is carried out until the thickness of the strip reaches up to 0.5 to 2.0 mm. In addition, in the case where the rolling becomes difficult owing to the phenomenon of strain hardening, an intermediate annealing of the strip may be carried out once or several times. The intermediate annealing is preferably carried out at a temperature of 230° to 350° C. In the case of carrying out the intermediate annealing, the cold rolling is carried out until the reduction ratio after the last step of intermediate annealing reaches up to a value of not less than 60%. In the case where the reduction ratio after the last step of intermediate annealing is less than 60%, even if the total reduction ratio is 60% or more, it is difficult to obtain a rolled strip showing excellent superplasticity.

The present invention will be explained more in detail while referring to the following examples, but these are not to be interpreted as limiting:

Examples 1 to 6 and Comparative Examples 1 to 5

Each of the aluminum alloys respectively having the compositions shown in Table 1 (further containing 0.16% of iron and not more than 0.01% of copper as the specified impurities and not more than 0.01% in total of other impurities) was molten in a gas furnace and sufficiently degassed therein at a molten alloy temperature of 750° C. Into this molten alloy, an aluminum master alloy containing 5% of titanium and 1% of boron was added so that the content of titanium in the aluminum alloy becomes 0.03%. Furthermore, another aluminum master alloy containing 2.5% of beryllium was respectively added so that the content of beryllium in the whole aluminum alloy becomes 20 to 30 ppm.

While using a driving mold constructed by a pair of watercooled rolls of 30 cm in diameter, the molten alloy mentioned above was continuously casted and rolled at 680° C. to be cast and rolled at a casting speed of 100 cm/min and thus the strips of 5.5 mm in thickness were produced.

The strips thus produced are subjected to homogenization treatment for 12 hours at a temperature respectively shown in Table 1 and then were subjected to cold rolling to obtain the rolled strips of 1.0 mm in thickness (at a reduction ratio of about 80%).

In Examples 1 to 6 and Comparative Examples 1 to 4, the strips were favorably rolled however, in Comparative Example 5, cracks occurred during cold rolling in the strips under processing and accordingly, it was impossible to roll the strips to the thickness of 1.0 mm.

Subsequently, the strips thus subjected to cold rolling (Examples 1 to 6 and Comparative Examples 1 to 4) were cut into test pieces of dimensions of about 150×150 mm and then the test pieces were examined by the bulge test. The metal mold of which the vertical cross-sectional view is shown in FIGS. 1 and 2 was used in the test. In FIGS. 1 and 2, (1), (2), (3) and (4) show the under metal mold, the upper metal mold, the test piece and a pipe for introducing compressed air, respectively. And l shows bulge height. While using the mold mentioned above, the test piece was blown under a pressure of 0.75 kg/cm$^2$.G into a hemi-spherical shape of 100 mm in diameter and the height thereof (bulge height) was measured at the time of puncture.

The results are shown in Table 2.

As clearly seen from Table 2, the alloy strips obtained by the process of the present invention have an excellent superplasticity.

TABLE 1

| | Composition of Alloys (%) | | | | | Temperature of homogenization treatment |
|---|---|---|---|---|---|---|
| | Mg | Si | Mn | Cr | Al | (°C.) |
| Example 1 | 4.9 | 2.2 | 0.55 | 0.15 | Balance | 475 |
| Example 2 | 5.2 | 3.0 | 0.55 | 0.14 | Balance | 475 |
| Example 3 | 6.0 | 3.0 | 0.50 | 0.15 | Balance | 475 |
| Example 4 | 6.9 | 3.0 | 0.56 | 0.15 | Balance | 475 |
| Example 5 | 8.0 | 4.0 | 0.52 | 0.17 | Balance | 500 |
| Example 6 | 2.9 | 1.1 | 0.5 | 0.15 | Balance | 475 |
| Comparative Example 1 | 5.2 | 3.0 | — | — | Balance | 450 |
| Comparative Example 2 | 6.0 | 3.0 | — | — | Balance | 450 |
| Comparative Example 3 | 6.9 | 4.0 | — | — | Balance | 450 |
| Comparative Example 4 | 1.9 | 1.1 | — | — | Balance | 450 |
| Comparative Example 5 | 9.3 | 4.4 | 0.50 | 0.15 | Balance | 500 |

TABLE 2

| | Test Temperature (°C.) | | |
|---|---|---|---|
| | 500 | 550 | 570 |
| Example 1 | — | — | 70 |
| Example 2 | — | — | 66 |
| Example 3 | — | 63 | 75 |
| Example 4 | 58 | 68 | 79 |
| Example 5 | — | — | 77 |
| Example 6 | — | — | 61 |
| Comparative Example 1 | 45 | 53 | 55 |
| Comparative Example 2 | — | — | 63 |

TABLE 2-continued

| | Test Temperature (°C.) | | |
|---|---|---|---|
| | 500 | 550 | 570 |
| Comparative Example 3 | — | — | 55 |
| Comparative Example 4 | — | — | 47 |

Note
The test results show a bulge height (mm).

Industrial Applicability

The aluminum alloy strips produced according to the process of the present invention show an excellent superplasticity at a temperature of higher than 400° C., particularly 450°-600° C. Accordingly, by using this superplasticity, these can be formed by various processing methods generally applied to the superplastic materials. The representative methods among them are the vacuum forming wherein a female mold is used and the material is closely adhered to the female mold by fluid pressure, and the bulging.

We claim:

1. A process for producing a superplastic aluminum alloy strip comprising the steps of continuously casting and rolling a molten aluminum alloy consisting essentially of 2.0 to 8.0% by weight of magnesium, 0.5 to 5.0% by weight of silicon, 0.05 to 1.2% by weight of manganese, 0.05 to 0.3% by weight of chromium and aluminum as the balance, thereby obtaining a cast and rolled strip of 3 to 20 mm in thickness, homogenizing said cast and rolled strip at a temperature of 430° to 550° C., subjecting the thus homogenized cast and rolled strip to cold rolling until the reduction ratio of the thickness thereof achieves a value of not less than 60% and further processing said strip while at a superplastic state.

2. A process according to claim 1, wherein in the course of said cold rolling, said strip is subjected to intermediate annealing and the annealed strip is subjected to further cold rolling until the reduction ratio reaches up to a value of not less than 60%.

3. A superplastic aluminum alloy strip which is produced by the process according to claim 1 or 2.

* * * * *

UNITED STATES PATENT AND TRADEMARK OFFICE

CERTIFICATE OF CORRECTION

PATENT NO. : 4,619,712

DATED : October 28, 1986

INVENTOR(S) : Hitoshi Miyamoto et al.

It is certified that error appears in the above-identified patent and that said Letters Patent is hereby corrected as shown below:

On the title page, Item [73] should read:

-- [73] Assignee: Kasei Naoetsu Light Metal Industries Limited, Tokyo, Japan --.

Signed and Sealed this

Twenty-ninth Day of September, 1987

*Attest:*

DONALD J. QUIGG

*Attesting Officer* *Commissioner of Patents and Trademarks*